US007703420B1

(12) United States Patent
Meissner et al.

(10) Patent No.: US 7,703,420 B1
(45) Date of Patent: Apr. 27, 2010

(54) SPLIT RADIATOR MAXIMIZING ENTERING TEMPERATURE DIFFERENTIAL

(75) Inventors: Alan Paul Meissner, Franklin, WI (US); Jeffrey J. Christenson, Juneau, WI (US); Randall Lee Chartrand, Gordon, WI (US); Dennis Michael Motl, Racine, WI (US)

(73) Assignee: IEA, Inc., Kenosha, WI (US)

( * ) Notice: Subject to any disclaimer, the term of this patent is extended or adjusted under 35 U.S.C. 154(b) by 0 days.

(21) Appl. No.: 12/409,454

(22) Filed: Mar. 23, 2009

Related U.S. Application Data

(63) Continuation of application No. 11/787,401, filed on Apr. 16, 2007, now Pat. No. 7,506,618.

(51) Int. Cl.
*F01P 1/06* (2006.01)

(52) U.S. Cl. ..... 123/41.31

(58) Field of Classification Search ..... 123/563, 123/41.08, 41.1, 552, 70 R, 41 R, 41.42, 123/41.78, 58.5, 65 VB, 69 R, 69 V, 73 CA; 60/602, 284, 605.2; 165/101, DIG. 103; *F01P 1/06*
See application file for complete search history.

(56) References Cited

U.S. PATENT DOCUMENTS 1,397,116 A * 11/1921 Sparks ..... 165/101
4,922,999 A * 5/1990 Stokes et al. ..... 165/286
5,215,044 A * 6/1993 Banzhaf et al. ..... 123/41.29
5,353,757 A * 10/1994 Susa et al. ..... 123/41.29
5,992,514 A * 11/1999 Sugimoto et al. ..... 165/135
2002/0088230 A1* 7/2002 Coleman et al. ..... 60/605.1

* cited by examiner

*Primary Examiner*—Stephen K Cronin
*Assistant Examiner*—Keith Coleman
(74) *Attorney, Agent, or Firm*—Brannen Law Office, LLC

(57) ABSTRACT

A heat exchanger is provided for dissipating heat from a dual turbocharged engine. The heat exchanger has a jacket water cooler, and first and second charge air coolers. The three coolers are arranged in parallel enabling each to operate with a maximum temperature differential, and have fronts that lie in parallel planes. Charge air from a first turbocharger is directly piped to the first charge air cooler, and charge air from the second turbocharger is directly piped to the second charge air cooler. A first baffle is between and upstream of the first charge air cooler and the jacket water cooler. A second baffle is between and upstream of the second charge air cooler and the jacket water cooler. The baffles can direct selected amounts of air to each of the three coolers and prevent radial convective scrubbing. A fuel oil cooler can also be provided.

19 Claims, 4 Drawing Sheets

SPLIT RADIATOR MAXIMIZING ENTERING TEMPERATURE DIFFERENTIAL

This application is a continuation application of United States patent application filed on Apr. 16, 2007 and having application Ser. No. 11/787,401 now U.S. Pat. No. 7,506,618, filed by the same inventors, the contents of which are hereby incorporated herein by reference.

BACKGROUND OF THE INVENTION

1. Field of the Invention

The present invention relates to a split heat exchanger, and particularly to a radiator with maximized entering temperature differentials for both at least one charge air cooler and a jacket water cooler.

2. Description of the Related Art

It is well known that heat energy contained in one fluid is capable of being transferred to another fluid. Such heat transfer is described in the classical heat transfer equation: $Q=UAdT$. In this equation, Q represents the heat transfer, U represents a coefficient of heat transfer, A represents the surface area through which the heat can be transferred, and dT represents the change in temperatures between the two mediums. Heat exchangers, and radiators in particular, are designed for a relative high level of transfer of heat energy from one medium to another. One common example is an automobile radiator, in which a coolant fluid passes through an engine to absorb heat energy from the engine. The coolant fluid then is routed through the radiator, where heat is transferred from the coolant fluid to the environment (ambient air).

Engineers and designers have incorporated many strategies to increase the amount of heat that a heat exchanger is capable of transferring. One strategy is to attempt to increase the coefficient of heat transfer. Design components, such as the incorporation of louvers, dimples, waves, ridges and other alterations to the fin profiles have been effectively used. While these improvements are quantifiable and generally useful, there are limitations (both practical and theoretical) as to how much the coefficient of heat transfer can be improved. For example, the increased tooling costs may overshadow any savings associated with the increased coefficient. Accordingly, it may take a long time to recapture those costs through efficiency savings, if it is even possible at all.

Others have had success in increasing the heat transferring capability of the heat exchanger by increasing the surface area between the two mediums (i.e. increasing the size of the heat exchanger). The increases in surface area can come from a combination of increases in height, width, depth and density of the heat exchanger. Often times, the size requirements for shipping and use dictate maximum dimensions in the height and width dimensions. In such situations, the only remaining variable is the depth of the unit. Accordingly, designers have increased the depth of the heat exchanger in order to increase the surface area.

Some heat exchangers are designed for use with engines having turbochargers. It is standard practice to stack two or more radiators in series to cool both a jacket water coolant from the engine and charge air compressed by one or more turbochargers. One configuration has a charge air cooler first, and a jacket water cooler second. Put another way, the charge air cooler is upstream of the jacket water cooler in some configurations, such that air first passes through the charge air cooler and second through the jacket water cooler. There are several drawbacks associated with such standard arrangements.

First, having a series stacked heat exchanger has a depth that is equal to the depth of both the jacket water cooler and the charge air cooler. Such a design has a depth that is often greater than that of a single radiator. Any additional depth can increase the system resistance, which is caused when pressure develops between the fan or air mover and the rear side (down stream side) of the jacket water cooler. Pressure can develop by expansion of the air as it gains energy from the heat exchanger, and also by overcoming obstructions to the free flow of the air. The fan therefore needs to have greater horsepower capacity (i.e. higher initial cost plus increased energy consumption during operation) in order to move the intended amount of air through the heat exchanger to overcome the increase in system pressure.

A further drawback of such an arrangement is that the ambient air first passes through the charge air cooler, and then passes through the jacket water cooler. The air enters the charge air cooler at ambient temperature (the maximum temperature differential). Heat energy is transferred from the charge air to the environmental air, such that the environmental air leaving the charge air cooler is warmer than the air entering the heat exchanger. The environmental air at an elevated temperature then enters the jacket water cooler where it again receives energy, this time transferred from the engine coolant. Yet, the air entering the jacket water cooler has a temperature above the ambient air temperature. Accordingly, the temperature differential between the coolant and the air is less than maximum, and the energy transfer is less than maximum. Such a design is disadvantageously engineered to be less than optimally efficient.

A still further drawback of the stacked system is that for dual turbocharged engines, a manifold is required to route the charge air through the charge air cooler. Several drawbacks can be associated with the use of a manifold. First, it would be undesirable if the return manifold did not evenly distribute the cooled charge air back to both sides of the engine. Second, the charge air can suffer from a pressure loss as it passes through the torturous paths of the manifold and other required piping. Pressure loss of the charge air during routing to and from the charge air cooler reduces the net effect of the turbochargers. Third, the piping and plumbing can add to the overall complexity of the design and manufacturing of the heat exchanger, and the piping and plumbing can be inconvenient to access.

It is well know that axial fans have a "dead" spot where the hub rotates due to the lack of air being driven. Non-uniform air flow rates in an axial direction are caused by the "dead" spots. The standard stacked arrangement prohibits mechanical compensation for different air flow rates across the front face of the heat exchanger due to the dead spot. Accordingly, some portions of the heat exchanger are capable at operating at higher efficiency relative the other portions making the overall heat transfer efficiency less than ideal. The zone of the dead spot and associated inefficiency is more profound downstream of the first heat exchanger where stacked arrangements are used.

Thus there exists a need for a heat exchanger that solves these and other problems.

SUMMARY OF THE INVENTION

The present invention is directed toward overcoming one or more of the disadvantages set forth above. The present invention relates to a heat exchanger, and particularly to a radiator with maximized entering temperature differentials for both at least one charge air cooler and a jacket water cooler.

According to one aspect of the present invention, a heat exchanger is provided for dissipating heat from a dual turbocharged engine. The heat exchanger can advantageously have a jacket water cooler, a first charge air cooler and a second charge air cooler. The three coolers can be arranged in parallel rather than in series (i.e. stacked arrangement), and each can have a front surface that lie, respectively, in parallel planes. The two charge air coolers are preferably located on opposite sides of the centrally located jacket water cooler. Charge air from the first turbocharger is piped to the first charge air cooler, and charge air from the second turbocharger is piped to the second charge air cooler. A first baffle is at least partially between the first charge air cooler and the jacket water cooler, and extends upstream there from. A second baffle is at least partially between the second charge air cooler and the jacket water cooler, and extends upstream there from. The baffles can direct selected amounts of air to each of the three coolers. The baffles also segregate the coolers to prevent radial convective scrubbing. A fuel oil cooler can also be provided.

According to one aspect of the present invention, a maximum entering temperature differential is provided for each cooler. This is accomplished by utilizing the relatively cool ambient air to enter each of the coolers, as opposed to having air first pass through a charge air cooler and then through a jacket water cooler.

According to another aspect of the present invention, the overall depth of the heat exchanger is decreased. Advantageously, the system resistance is decreased as a result of the side-by-side geometry of the jacket water cooler and the charge air coolers. Lowering the system resistance and pressure decreases parasitic energy loss via the fan or other components, and increases the efficiency of the heat exchanger. Accordingly, a fan with relatively less horsepower is required to move the necessary amount of air through the heat exchanger.

According to a further advantage, the plumbing to each of the charge air coolers is relatively uncomplicated, and comprises distinct cooling circuits. Pressure loss in the charge air circuits is advantageously decreased. All pressure loss in the charge air circuit decreases the net effect of the turbocharger. There is accordingly an incentive to minimize pressure losses in the charge air circuits. Also, the plumbing is more convenient to facilitate ease of assembly and service.

According to a still further advantage, selected amounts of axially moving air pushed from the fan can be directed to the jacket water cooler and each of the charge air coolers. This is accomplished with baffles that direct some of the ambient air to the area that conventionally is referred to as the "dead" spot. The baffles accordingly ensure proper flow through each of the coolers.

According to a still further advantage yet, the baffles segregate the coolers from each other. One component of the air flow of axial fans moves radially from the fan (the other component is the axially linear movement) and generally parallel to the front of the coolers. The baffles prevent the radial motion of the air from sweeping between coolers and transferring heat between the coolers and passing through the heat exchanger at the point of least resistance.

Other advantages, benefits, and features of the present invention will become apparent to those skilled in the art upon reading the detailed description of the invention and studying the drawings.

DETAILED DESCRIPTION OF THE PREFERRED EMBODIMENTS

Figure 1:
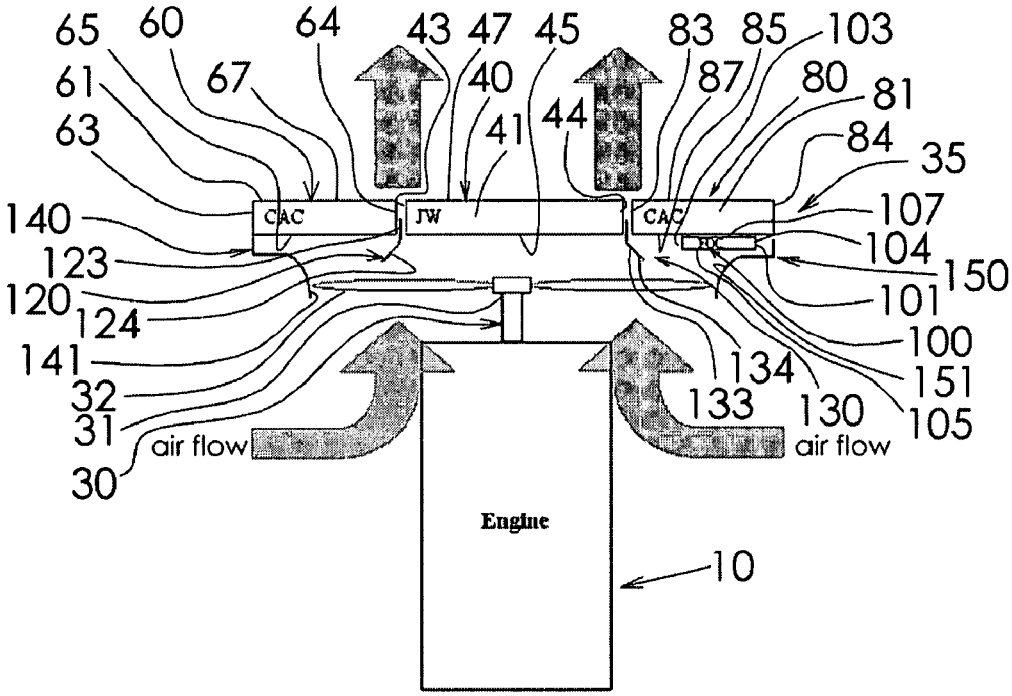
FIG. 1 is a schematic top view showing external air flow through the heat exchanger of the present invention.

While the invention will be described in connection with several preferred embodiments, it will be understood that it is not intended to limit the invention to those embodiments. On the contrary, it is intended to cover all alternatives, modifications and equivalents as may be included within the spirit and scope of the invention as defined by the appended claims.

The present invention is intended for use with an engine 10 designed for use with two turbochargers 20 and 25, respectively. Preferably, the engine 10 is a stationary engine. Yet, it is understood that the principals of the present invention could be applied to mobile engines. It is further understood that in a forced convection application, the mechanical air mover or fan may be unnecessary. The engine 10 has a coolant inlet 11 and a coolant outlet 12. The engine 10 further has a first charge air inlet 13 and a second charge air inlet 14. The charge air inlets 13 and 14 are preferably on opposed sides of the engine 10. A fuel inlet 15 is further provided, as well as an excess fuel outlet 16.

Two turbochargers 20 and 25 are used with the engine 10. Turbochargers 20 and 25 each comprise two chambers. The chambers house a turbine and a compressor, respectively. It is typical for a common shaft to connect the turbine blades and the compressor blades. Exhaust from the engine flowing out of exhaust enters the turbine and expands through the turbine blades. The expansion through the turbine blades cause the blades and shaft to rotate at a high rate of speed. The rotation of the shaft causes the blades in the compressor to likewise rotate. The compressor blades pull ambient air into the compressor to compress the air to relatively high temperature and pressure.

An air mover is provided. One preferred air mover is a fan 30. The fan 30 has a hub 31 and blades 32. The fan 30 has a central axial axis. The blades 32 can be formed with a selected pitch to achieve an intended linear axial flow of ambient air at the ambient air temperature. A schematic diagram of the air flow is shown in FIG. 1. A second component of the air flow from the fan is radial flow. The radial flow is caused by the rotation of the blades and is due to the pitch of the blades. The radial flow typically moves generally perpendicular to the axial flow. The illustrated embodiment utilizes a pusher fan. However, it is understood that a puller fan or any other type of mechanical air convection apparatus such as a blower could alternatively be used without departing from the broad aspects of the present invention.

A heat exchanger 35 is provided for dissipating heat from the engine 10, and cooling the charged air from the turbochargers 20 and 25. The heat exchanger 35 has a frame 36. Some other primary components include a jacket water cooler 40, a first charge air cooler 60, a second charge air cooler 80, a fuel oil cooler 100, a first baffle 120 and a second baffle 130. A detailed description of each of these components follows. The heat exchanger has a first side bracket 140 with a face 141, and a second side bracket 150 with face 151. The first and second brackets 140 and 150 define the outside side walls of the heat exchanger. The front of the heat exchanger 35 is upstream, and the rear of the heat exchanger is downstream.

Looking now at FIGS. 1-5, it is shown that a jacket water cooler 40 is provided for dissipating heat from the engine coolant fluid. This cooler 40 is preferably a liquid to air heat exchanger. It can be constructed of metal oval tubes and metal flat fins. The tubes can be aligned in a staggered pattern and can be multiple rows deeps. Coolant can flow into and out of the cooler 40 through metal or steel nozzles. It is understood that while the description heretofore represents preferred construction, other embodiments can be used without departing from the broad aspects of the present invention. The jacket water cooler 40 is preferably held in place by the frame 36 of the heat exchanger 35. The jacket water cooler 40 has a top 41, a bottom 42, a first side 43, a second side 44 and a front 45. The front 45 of the jacket water cooler 40 preferably is planar and lies in plane 46. The front 45 is preferably upstream of a back 47.

Figure 2:
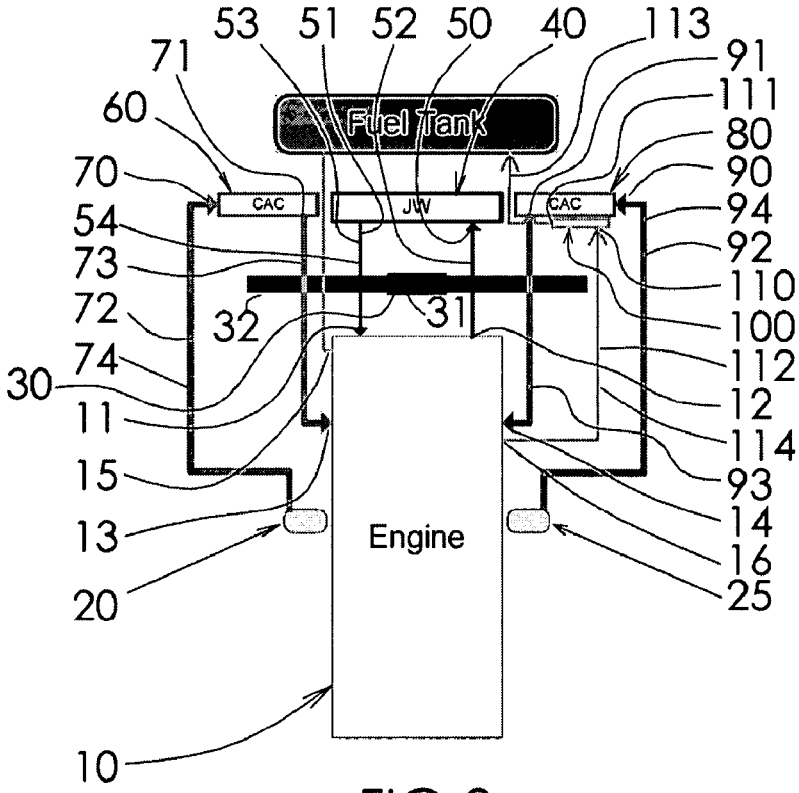
FIG. 2 is a schematic top view showing the independent internal cooling circuits of the present invention.

A coolant inlet 50 is provided, as is a coolant outlet 51. The inlet is preferably located at or near the top 45 of the jacket water cooler 40. The outlet 51 is preferably located at or near the bottom of the jacket water cooler 40. An inlet line 52 is provided. The inlet line 52 has a first end connected to the coolant outlet 12 of the engine, and a second end connected to the coolant inlet 50 of the jacket water cooler. An outlet line 53 is also provided. The outlet line 53 has a first end connected to the coolant inlet 11 of the engine 10, and a second end connected to the coolant outlet 51 of the jacket water cooler 40. It is appreciated that, as shown in FIG. 2, the jacket water cooler 40, the inlet line 52 and the outlet line 53 comprise a jacket water cooling circuit. The jacket water cooling circuit 54 is a distinct and independent internal cooling circuit.

A first charge air cooler 60 is provided for dissipating heat from the charge air from the first turbocharger 20. This cooler 60 is preferably an air to air heat exchanger. It can be constructed of metal oval tubes and metal serpentine fins. The tubes can be aligned in a parallel pattern and can be multiple rows deeps. Air can flow into and out of the cooler 60 through aluminum nozzles. It is understood that while the description heretofore represents preferred construction, other embodiments can be used without departing from the broad aspects of the present invention. The first charge air cooler 60 is preferably held in place by the frame 36 of the heat exchanger 35. The first charge air cooler 60 has a top 61, a bottom 62, a first side 63, a second side 64 and a front 65. The front 65 of the first charge air cooler 60 preferably is planar and lies in plane 66. The front 65 is preferably upstream of a back 67.

A charge air inlet 70 is provided, as is a charge air outlet 71. The inlet is preferably located at or near the top 61 of the first charge air cooler 60. The outlet 71 is preferably located at or near the bottom of the first charge air cooler 60. An inlet line 72 is provided. The inlet line 72 has a first end connected to the first turbocharger 20 for receiving charge air, and a second end connected to the charge air inlet 70 of the first charge air cooler. An outlet line 73 is also provided. The outlet line 73 has a first end connected to the first charge air inlet 13 of the engine 10, and a second end connected to the charge air outlet 71 of the first charge air cooler 60. It is appreciated that, as shown in FIG. 2, first charge air cooler 60, the inlet line 72 and the outlet line 73 comprise a first charge air cooling circuit 74. The first charge air cooling circuit 74 is a distinct and independent internal cooling circuit.

The first charge air cooler 60 is preferably located near the jacket water cooler 40 in a parallel arrangement. Stated another way, the first charge air cooler 60 and the jacket water cooler 40 are neither upstream nor downstream of each other. This is accomplished as side 64 of the first charge air cooler 60 is near the side 43 of the jacket water cooler 40. The front surface 45 of the jacket water cooler 40 is also preferably parallel to the front surface 65 of the first charge air cooler 60, such that both are preferably perpendicular to the axial flow of ambient air driven by the fan.

A second charge air cooler 80 is provided for dissipating heat from the charge air from the second turbocharger 25. This cooler 80 is preferably an air to air heat exchanger. It can be constructed of metal oval tubes and metal serpentine fins. The tubes can be aligned in a parallel pattern and can be multiple rows deeps. Air can flow into and out of the cooler 80 through aluminum nozzles. It is understood that while the description heretofore represents preferred construction, other embodiments can be used without departing from the broad aspects of the present invention. The second charge air cooler 80 is preferably held in place by the frame 36 of the heat exchanger 35. The second charge air cooler 80 has a top 81, a bottom 82, a first side 83, a second side 84 and a front 85. The front 85 of the second charge air cooler 80 preferably is planar and lies in plane 86. The front 85 is preferably upstream of a back 87.

A charge air inlet 90 is provided, as is a charge air outlet 91. The inlet is preferably located at or near the top 81 of the second charge air cooler 80. The outlet 91 is preferably located at or near the bottom of the second charge air cooler 80. An inlet line 92 is provided. The inlet line 92 has a first end connected to the second turbocharger 25 for receiving charge air, and a second end connected to the charge air inlet 90 of the second charge air cooler. An outlet line 93 is also provided. The outlet line 93 has a first end connected to the second charge air inlet 14 of the engine 10, and a second end connected to the charge air outlet 91 of the second charge air cooler 80. It is appreciated that, as shown in FIG. 2, second charge air cooler 80, the inlet line 92 and the outlet line 93 comprise a second charge air cooling circuit 94. The second charge air cooling circuit 94 is a distinct and independent internal cooling circuit.

The second charge air cooler 80 is preferably located near the jacket water cooler 40 in a parallel arrangement. The second charge air cooler 80 is preferably on an opposed side of the jacket water cooler 40 from the first charge air cooler 60. The first charge air cooler 60, the second charge air cooler 80 and the jacket water cooler 40 are neither upstream nor downstream of each other. This is accomplished as side 83 of the second charge air cooler 80 is near the side 44 of the jacket water cooler 40. The front surface 45 of the jacket water cooler 40 is also preferably parallel to the front surface 85 of the second charge air cooler 80, such that both are preferably perpendicular to the axial flow of ambient air driven by the fan.

Figure 3:
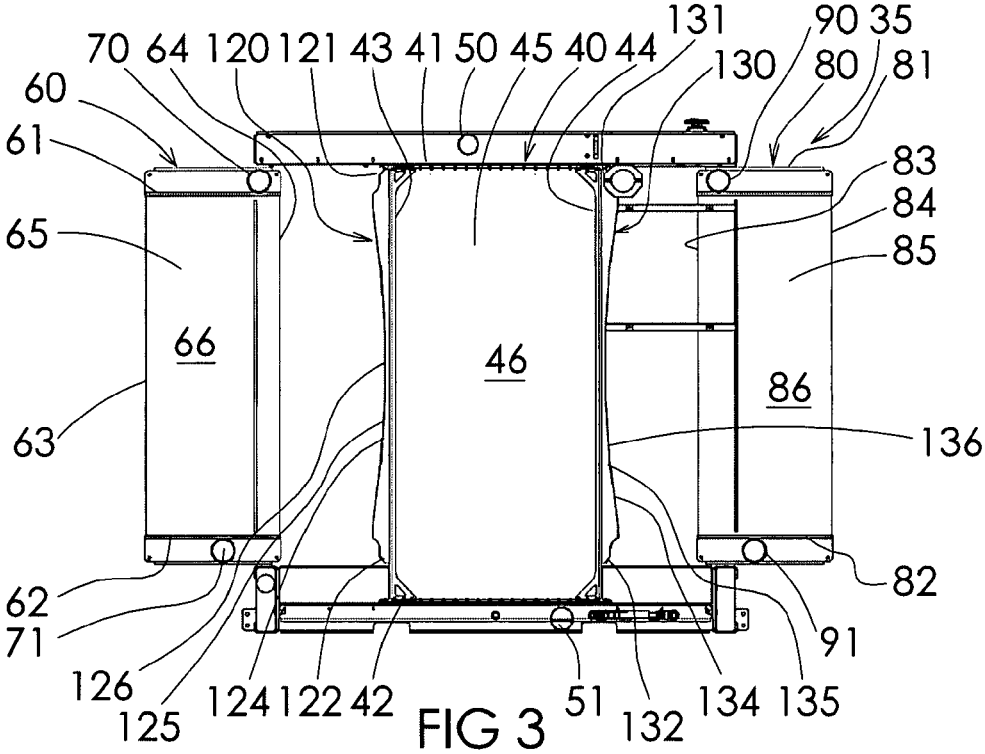
FIG. 3 is an exploded front view of the jacket water cooler and the two charge air coolers of a preferred embodiment of the present invention.

A fuel oil cooler 100 is provided for dissipating heat from the excess fuel from the engine 10. This cooler 100 is preferably a liquid to air heat exchanger. It can be constructed of metal round tubes and metal flat fins. Fuel can flow into and out of the cooler 100 through metal nozzles. It is understood that while the description heretofore represents preferred construction, other embodiments can be used without departing from the broad aspects of the present invention. The fuel oil cooler 100 is preferably held in place by brackets that are supported by the frame 36 of the heat exchanger 35, as best shown in FIG. 3. The fuel oil cooler 100 has a top 101, a bottom 102, a first side 103, a second side 104 and a front 105. The front 105 of the fuel oil cooler 100 preferably is planar and lies in plane 106. The front 105 is preferably upstream of a back 107.

An inlet 110 is provided by the fuel oil cooler 100, as is an outlet 111. An inlet line 112 is provided. The inlet line 112 has a first end connected to the excess fuel outlet 16 of the engine 10, and a second end connected to the fuel oil cooler inlet 110. An outlet line 113 is also provided. The outlet line 113 has a first end connected to a fuel reservoir, and a second end connected to the outlet 111 of the fuel oil cooler 100. It is appreciated that, as shown in FIG. 2, fuel oil cooler 100, the inlet line 112 and the outlet line 113 comprise a fuel oil cooler circuit 114.

Figure 3A:
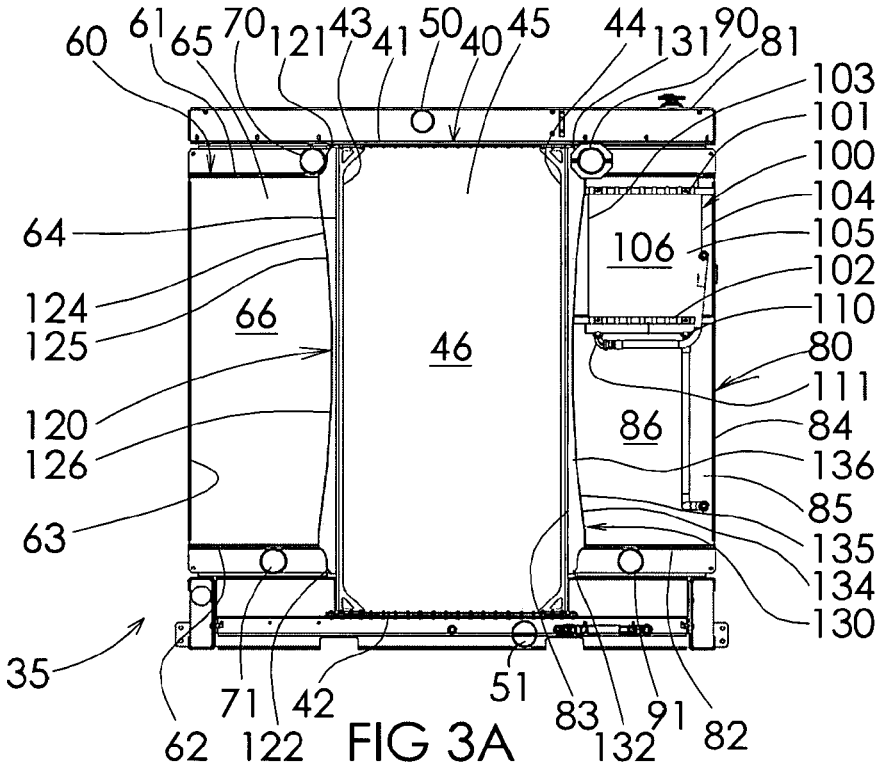
FIG. 3A is a front view of the jacket water cooler and the charge air coolers of the present invention showing the side-by-side parallel arrangement.
Figure 4:
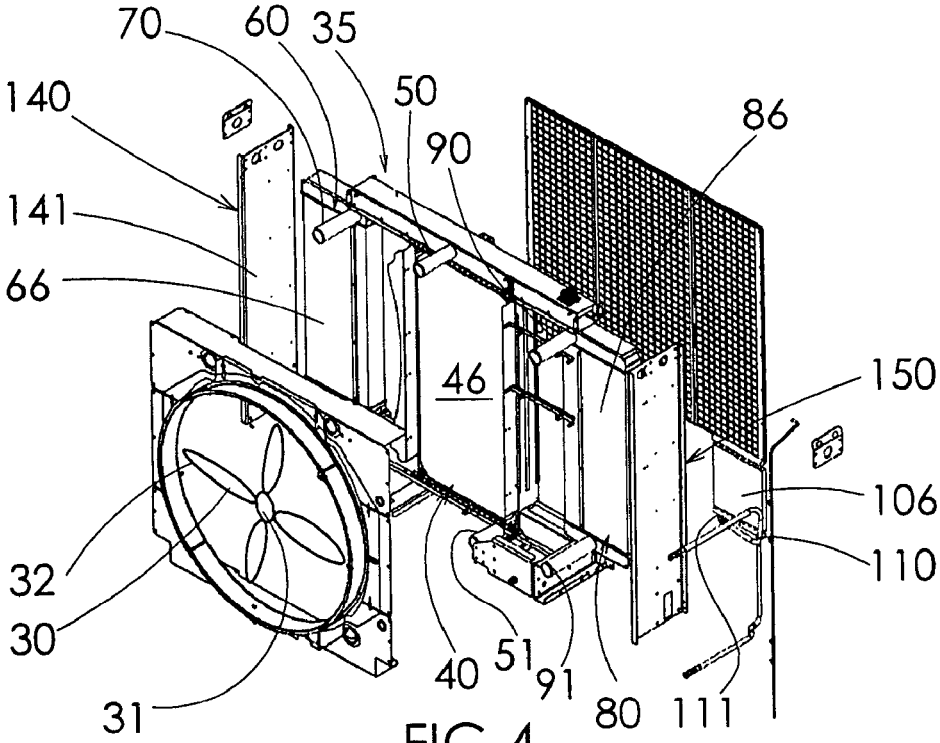
FIG. 4 is an exploded perspective view of a preferred embodiment of the present invention.
Figure 5:
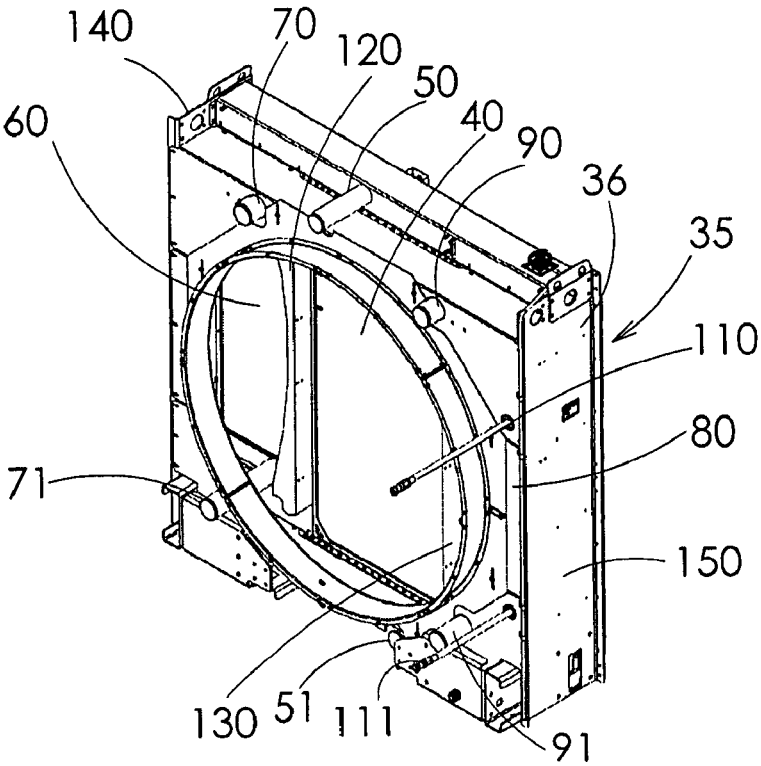
FIG. 5 is a perspective view of a preferred embodiment of the present invention.
Figure 6:
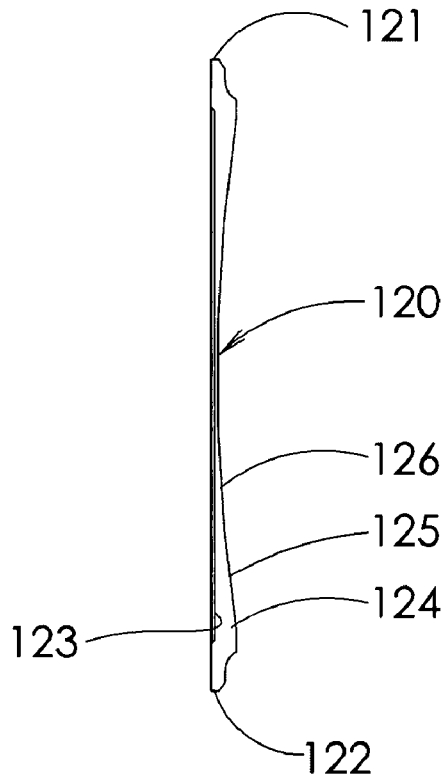
FIG. 6 is a rear view of a baffle of the present invention.

In the illustrated embodiment, the fuel oil cooler 100 is stacked upstream of the second charge air cooler 80. The surface area of the front 105 of the fuel oil cooler is much smaller that the surface area of the second charge air cooler 80, as shown in FIG. 3A. The front 105 of the fuel oil cooler is preferably parallel to the front 85 of the second charge air cooler 80.

Turning attention now to FIGS. 1, 3, 3A and 6, a first baffle 120 is illustrated. Baffle 120 is preferably made of metal. The baffle 120 has a top 121 and a bottom 122. The baffle comprises a first segment, or partition 123, and a second segment, or face 124. The face 124 has a leading edge 125. The leading edge is preferably concave and has an arch 126 or curve. The baffle partition segment 123 and face segment 124 can be rigidly connected or adjustably connected. It is understood that alternative shapes could be used without departing from the broad aspects of the present invention.

The partition 123 can be partially between the first charge air cooler 60 and the jacket water cooler 40. The face 124 extends upstream from between the coolers 60 and 40. The face 124 is preferably angled towards the bracket 140 and the outside of the heat exchanger such that it is upstream of the first charge air cooler. The face 124 divides the ambient air driven by the fan and directs selected amounts of air to pass through each of the jacket water cooler 40 and the first charge air cooler 60. In this regard, the air entering at the ambient air temperature independently passes through the jacket water cooler 40 and the fist charge air cooler 60. The face 124 also prevents radial convective scrubbing, or air that is swept radially from scrubbing across one of the coolers 60 or 40 and heating the other cooler, such as from cooler 60 to cooler 40.

A second baffle 130 is also provided according to the present invention. Baffle 130 is preferably made of metal. The baffle 130 has a top 131 and a bottom 132. The baffle comprises a first segment, or partition 133, and a second segment, or face 134. The face 134 has a leading edge 135. The leading edge is concave and has an arch 136 or curve. The baffle partition segment 133 and face segment 134 can be rigidly connected or adjustably connected. It is understood that other shapes could be used without departing from the broad aspects of the present invention.

The partition 133 is at least partially between the second charge air cooler 80 and the jacket water cooler 40. The face 134 extends upstream from between the coolers 80 and 40. The face 134 is preferably angled towards the bracket 150 and the outside of the heat exchanger such that it is upstream of the second charge air cooler. The face 134 divides the ambient air driven by the fan and directs selected amounts of air to pass through each of the jacket water cooler 40 and the second charge air cooler 80. In this regard, the air entering at the ambient air temperature independently passes through the jacket water cooler 40 and the second charge air cooler 80. It is understood that a portion of the air passes through the fuel oil cooler 100 before passing through the second charge air cooler 80. The face 134 also prevents radial convective scrubbing, or air that is swept radially from scrubbing across one of the coolers 80 or 40 and heating the other cooler, such as cooler 80 to cooler 40.

Figure 7:
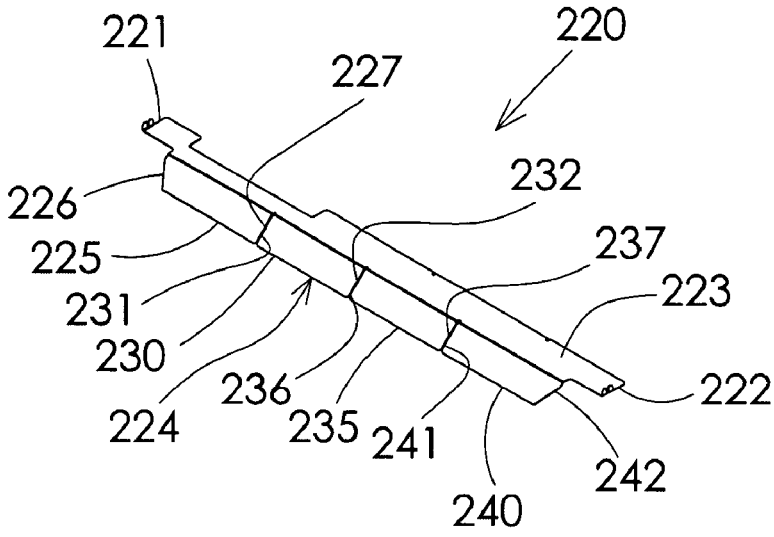
FIG. 7 is a perspective view of an alternative baffle of the present invention.

Turning attention now to FIG. 7, an alternative baffle 220 is illustrated. Baffle 220 is preferably made of metal. The baffle 220 has a top 221 and a bottom 222. The baffle comprises a first segment, or partition 223, and a second segment, or face 224. The face 224 can be split into a plurality of tabs. In one embodiment, four tabs 225, 230, 235 and 240 are provided. Tab 225 has a first end 226 and a second end 227. Tab 230 has a first end 231 and a second end 232. Tab 235 has a first end 236 and a second end 237. Tab 240 has a first end 241 and a second end 242. One or more of the tabs can be selectably moved to any desired angle with respect to the partition 223. The baffle partition segment 223 and face segment 224 can be rigidly connected or adjustably connected.

The partition 223 can be partially between the first charge air cooler and the jacket water cooler. The face 224 extends upstream from between the jacket water cooler and the first charge air cooler. The face 224 is preferably angled towards the bracket and the outside of the heat exchanger such that it is upstream of the first charge air cooler. The face 224 divides the ambient air driven by the fan and directs selected amounts of air to pass through each of the jacket water cooler and the first charge air cooler. In this regard, the fan causes air entering at the ambient air temperature to independently pass through the jacket water cooler and the first charge air cooler. The face 224 also prevents radial convective scrubbing, or air that is swept radially from scrubbing across one of the coolers and heating the other cooler.

It is understood that a second similar shaped baffle (not shown) could be used between and upstream of the second charge air cooler and the jacket water cooler.

Looking now at FIGS. 1 and 2, it is seen that each of the jacket water cooling circuit 54, the first charge air circuit 74 and the second charge air circuit 94 take advantage of ambient air at non-elevated ambient air temperature. The baffles 120 and 130 ensure that a desired amount of air pass through each of these coolers, and in particular direct air to the traditional "dead" spot in front of the hub 31 of the fan 30. The baffles 120 and 130 thermally segregate the coolers by preventing swept air from passing through more than one cooler. In this regard, each molecule of air passes though only one of the jacket water cooler 40, the first charge air cooler 60 and the second charge air cooler 80 (the external air cooling circuits).

The system resistance normally associated with fully stacked systems is decreased by the present invention, as the air passes through only one cooler. Accordingly, the driving potential of the air mover is increased. Further, the baffles ensure that selected amounts of air pass through each cooler and prevent all the driven air from passing through the cooler with the least resistance.

It is noteworthy that the first charge air circuit 74 is direct to the first charge air cooler 60 and then to the first engine intake 13, and the second charge air circuit 94 is direct to the second charge air cooler 80 and to the second engine intake 14. The separate internal cooling circuits allows for the heat exchanger to operate without complex installation and manifolding.

Thus it is apparent that there has been provided, in accordance with the invention, a radiator that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A heat exchanger for an engine producing heat with a first turbocharger and a second turbocharger, said heat exchanger comprising:

a jacket water cooler for dissipating heat from the engine and comprising a jacket water cooler top, a jacket water cooler bottom, a jacket water cooler first side, a jacket water cooler second side and a jacket water cooler front lying in a jacket water cooler plane;

a first charge air cooler for cooling the charge air from the first turbocharger and comprising a first charge air cooler top, a first charge air cooler bottom, a first charge air cooler first side, a first charge air cooler second side and a first charge air cooler front lying in a first charge air cooler plane;

a second charge air cooler for cooling the charge air from the second turbocharger and comprising a second charge air cooler top, a second charge air cooler bottom, a second charge air cooler first side, a second charge air cooler second side and a second charge air cooler front lying in a second charge air cooler plane; and a frame, wherein said jacket water cooler, said first charge air cooler and said second charge air cooler are held in place by said frame, said frame holds at least one of:

said jacket water cooler top, said first charge air cooler top and said second charge air cooler top; and said jacket water cooler bottom, said first charge air cooler bottom and said second charge air cooler bottom, and the surface area of said jacket water cooler front, said first charge air cooler front and said second charge air cooler front, respectively, that is subject to a flow of ambient air remains constant throughout operation of said heat exchanger.

2. The heat exchanger of claim 1 wherein said frame is a unitary piece.

3. The heat exchanger of claim 1 wherein said frame holds said jacket water cooler top, said first charge air cooler top, said second charge air cooler top, said jacket water cooler bottom, said first charge air cooler bottom and said second charge air cooler bottom.

4. The heat exchanger of claim 1 wherein:

said first charge air cooler second side is adjacent said jacket water cooler first side; and said second charge air cooler first side is adjacent said jacket water cooler second side.

5. The heat exchanger of claim 1 wherein said jacket water cooler front, said first charge air cooler front and said second charge air cooler front are generally parallel to each other.

6. The heat exchanger of claim 1 further comprising:

an air mover for moving air across said first charge air cooler, said jacket water cooler and said second charge air cooler;

a first baffle having a first baffle first side and a first baffle second side, said first baffle being between said first charge air cooler and said jacket water cooler; and a second baffle having a second baffle first side and a second baffle second side, said second baffle being between said second charge air cooler and said jacket water cooler.

7. The heat exchanger of claim 6 wherein:

said first baffle extends upstream of said first charge air cooler and said jacket water cooler to divide air moved by said air mover to pass on each of said first baffle first side and said first baffle second side and accordingly between said first charge air cooler and said jacket water cooler; and said second baffle extends upstream of said second charge air cooler and said jacket water cooler to divide air moved by said air mover to pass on each of said second baffle first side and said second baffle second side, and accordingly between said second charge air cooler and said jacket water cooler.

8. The heat exchanger of claim 6 wherein:

said first baffle is generally vertically oriented; and said second baffle is generally vertically oriented.

9. A heat exchanger for an engine producing heat with a first turbocharger and a second turbocharger, said heat exchanger comprising:

a jacket water cooler for dissipating heat from the engine;

a first charge air cooler for cooling the charge air from the first turbocharger;

a second charge air cooler for cooling the charge air from the second turbocharger; and a frame, wherein:

said frame is a unitary frame; and said jacket water cooler, said first charge air cooler and said second charge air cooler are directly supported by said frame.

10. The heat exchanger of claim 9 wherein:

said jacket water cooler comprises a jacket water cooler top, a jacket water cooler bottom, a jacket water cooler first side and a jacket water cooler second side;

said first charge air cooler comprises a first charge air cooler top, a first charge air cooler bottom, a first charge air cooler first side and a first charge air cooler second side;

said second charge air cooler comprises a second charge air cooler top, a second charge air cooler bottom, a second charge air cooler first side and a second charge air cooler second side; and said frame holds at least one of:

said jacket water cooler top, said first charge air cooler top and said second charge air cooler top; and said jacket water cooler bottom, said first charge air cooler bottom and said second charge air cooler bottom.

11. The heat exchanger of claim 10 wherein said frame holds:

said jacket water cooler top and said jacket water cooler bottom;

said first charge air cooler first side, said first charge air cooler top and said first charge air cooler bottom; and said second charge air cooler second side, said second charge air cooler top and said second charge air cooler bottom.

12. The heat exchanger of claim 10 wherein:

said jacket water cooler has a jacket water cooler front lying in a jacket water cooler plane;

said first charge air cooler has a first charge air cooler front lying in a first charge air cooler plane;

said second charge air cooler has a second charge air cooler front lying in a second charge air cooler plane; and the surface area of said jacket water cooler front, said first charge air cooler front and said second charge air cooler front, respectively, that is subject to a flow of ambient air remains constant throughout operation of said heat exchanger.

13. The heat exchanger of claim 10 further comprising:

an air mover for moving air across said first charge air cooler, said jacket water cooler and said second charge air cooler;

a first baffle having a first baffle first side and a first baffle second side, said first baffle being between said first charge air cooler and said jacket water cooler; and a second baffle having a second baffle first side and a second baffle second side, said second baffle being between said second charge air cooler and said jacket water cooler.

14. A heat exchanger for an engine producing heat with a first turbocharger and a second turbocharger, said heat exchanger comprising:

a jacket water cooler for dissipating heat from the engine, said jacket water cooler having a jacket water cooler front lying in a jacket water cooler plane;

a first charge air cooler for cooling the charge air from the first turbocharger, said first charge air cooler having a first charge air cooler front lying in a first charge air cooler plane;

a second charge air cooler for cooling the charge air from the second turbocharger, said second charge air cooler having a second charge air cooler front lying in a second charge air cooler plane; and an air mover, wherein the surface area of said jacket water cooler front, said first charge air cooler front and said second charge air cooler front, respectively, that is subject to a flow of ambient air remains constant throughout operation of said heat exchanger.

15. The heat exchanger of claim 14 further comprising a frame, wherein said jacket water cooler, said first charge air cooler and said second charge air cooler are directly supported by said frame.

16. The heat exchanger of claim 15 wherein:

said jacket water cooler comprises a jacket water cooler top, a jacket water cooler bottom, a jacket water cooler first side and a jacket water cooler second side;

said first charge air cooler comprises a first charge air cooler top, a first charge air cooler bottom, a first charge air cooler first side and a first charge air cooler second side;

said second charge air cooler comprises a second charge air cooler top, a second charge air cooler bottom, a second charge air cooler first side and a second charge air cooler second side; and said frame holds at least one of:

said jacket water cooler top, said first charge air cooler top and said second charge air cooler top; and said jacket water cooler bottom, said first charge air cooler bottom and said second charge air cooler bottom.

17. The heat exchanger of claim 15 wherein said frame holds:

said jacket water cooler top and said jacket water cooler bottom;

said first charge air cooler first side, said first charge air cooler top and said first charge air cooler bottom; and said second charge air cooler second side, said second charge air cooler top and said second charge air cooler bottom.

18. The heat exchanger of claim 14 further comprising:

a first baffle having a first baffle first side and a first baffle second side, said first baffle being between said first charge air cooler and said jacket water cooler; and a second baffle having a second baffle first side and a second baffle second side, said second baffle being between said second charge air cooler and said jacket water cooler.

19. A heat exchanger for an engine producing heat with a first turbocharger and a second turbocharger, said heat exchanger comprising:

a jacket water cooler for dissipating heat from the engine and comprising a jacket water cooler top, a jacket water cooler bottom, a jacket water cooler first side and a jacket water cooler second side;

a first charge air cooler for cooling the charge air from the first turbocharger and comprising a first charge air cooler top, a first charge air cooler bottom, a first charge air cooler first side and a first charge air cooler second side;

a second charge air cooler for cooling the charge air from the second turbocharger and comprising a second charge air cooler top, a second charge air cooler bottom, a second charge air cooler first side and a second charge air cooler second side;

a frame;

an air mover for moving air across said first charge air cooler, said jacket water cooler and said second charge air cooler;

a first baffle having a first baffle first side and a first baffle second side, said first baffle being between said first charge air cooler and said jacket water cooler; and a second baffle having a second baffle first side and a second baffle second side, said second baffle being between said second charge air cooler and said jacket water cooler, wherein said jacket water cooler, said first charge air cooler and said second charge air cooler are held in place by said frame, and said frame holds at least one of:

said jacket water cooler top, said first charge air cooler top and said second charge air cooler top; and said jacket water cooler bottom, said first charge air cooler bottom and said second charge air cooler bottom.

* * * * *